US006079418A

United States Patent [19]

Russo

[11] Patent Number: 6,079,418

[45] **Date of Patent: *Jun. 27, 2000**

[54] TOBACCO PRODUCTS WITH DRY POWDERED VITAMIN E

[75] Inventor: Joseph D. Russo, Palo Alto, Calif.

[73] Assignee: Rousseau Research, Inc., Palo Alto, Calif.

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 09/064,021

[22] Filed: Apr. 21, 1998

Related U.S. Application Data

[63] Continuation-in-part of application No. 09/020,958, Feb. 9, 1998.

[51] Int. Cl.[7] ..... A24F 47/00; A24B 15/00; A24B 15/30

[52] U.S. Cl. ..... 131/347; 131/275; 131/276; 131/352

[58] Field of Search ..... 131/275, 276, 131/277, 352, 335, 270

[56] References Cited

U.S. PATENT DOCUMENTS

| | | | |
|---|---|---|---|
| 3,339,558 | 9/1967 | Waterbury . | |
| 3,667,478 | 6/1972 | Waterbury . | |
| 4,516,588 | 5/1985 | Rudolph et al. | 131/291 |
| 5,016,655 | 5/1991 | Waddell et al. . | |
| 5,048,546 | 9/1991 | Hsu et al. . | |
| 5,084,563 | 1/1992 | Sakai et al. . | |
| 5,371,245 | 12/1994 | Rindone et al. . | |
| 5,829,449 | 11/1998 | Hersh et al. | 131/202 |

FOREIGN PATENT DOCUMENTS

| | | |
|---|---|---|
| 0 550 337 A1 | 12/1992 | European Pat. Off. . |
| 0 770 577 A1 | 5/1997 | European Pat. Off. . |
| 2 212 722 | 8/1989 | United Kingdom . |
| 95/28098 | 10/1995 | WIPO . |
| WO 95/28098 | 10/1995 | WIPO . |
| WO 97/25876 | 7/1997 | WIPO . |

OTHER PUBLICATIONS

AOL Net (Find) Results—search report.
Derwent Search Report.

*Primary Examiner*—Stanley S. Silverman
*Assistant Examiner*—Jacqueline A Ruller
*Attorney, Agent, or Firm*—Townsend and Townsend and Crew, LLP; Guy W. Chambers, Esq.

[57] ABSTRACT

A substantially pure Vitamin E type compound is added to tobacco for a smokeable or smokeless tobacco product to achieve less irritation and antioxidant benefits. In a preferred embodiment, a substantially pure "dry" powdered ester analog of Vitamin E, such as Vitamin E acid succinate or spray dried Vitamin E acetate, is mixed directly with the tobacco during the manufacturing process. These Vitamin E analogs can also be inserted into a cigarette filter, holder and/or paper, either in powdered form or in microencapsulated form. Although not preferred, a common oily form of Vitamin E can be used in the present invention so long as it does not ruin the appearance and function of the smokeable or smokeless tobacco product.

5 Claims, 1 Drawing Sheet

TOBACCO PRODUCTS WITH DRY POWDERED VITAMIN E

This is a continuation-in-part of U.S. application Ser. No. 09/020,958, entitled "Cigarette With Vitamin E", filed Feb. 9, 1998 and still pending.

TECHNICAL FIELD OF THE INVENTION

The present invention relates to smoking tobacco products, such as cigarettes, cigars, pipe tobacco (bulk), and smokeless tobacco products, also known as chewing tobacco. More particularly, a novel form of smokeable cigarette, cigar and bulk tobacco and smokeless tobacco is disclosed which includes a health enhancing Vitamin E type additive.

BACKGROUND OF THE INVENTION

Health problems associated with cigarette smoking, cigar smoking, pipe smoking and smokeless tobacco have been well publicized. In various scientific studies, cigarette smoking, cigar smoking, pipe smoking and use of smokeless tobacco have been linked to diseases such as lung, throat, mouth and other cancers as well as emphysema, smoker's cough and heart trouble.

Various attempts have been made to address cigarette health problems through reformulation of cigarettes. For example, special blends of tobacco have been formulated for cigarettes with reduced levels of tar and nicotine. Unfortunately, each reduction of the tar and nicotine level has been accompanied by a corresponding reduced level of smoker satisfaction. As such, sales of lowered tar and nicotine cigarettes, particularly those commercially classified as "ultra low tar and nicotine", have not lived up to expectations. More recently, efforts have been made to altogether remove additives from cigarettes. While such "additive free" cigarettes may provide a purer smoke, it is unclear whether they provide any corresponding health benefits. In fact, because they contain no additive diluents, their tar and nicotine levels are increased.

Attempts have also been made to insert additives into cigarettes to offset some of the hazardous substances present in tobacco. For example, U.S. Pat. No. 5,016,655 ("'655 patent") recommends insertion of alcohols into the tobacco or filters of cigarettes in order to neutralize the carcinogenic effect of N-nitrosamines, such as N'-Nitrosonoronicotine (NNN). According to the '655 patent, these alcohols can be advantageously packaged with other chemicals such as Vitamins A, B, C and E. Nonetheless, in Table IV of the '655 patent, it is taught that use of Vitamin E as a stand-alone additive (i.e., apart from an alcohol mixture) is ineffective in neutralizing NNN.

Similarly, in published PCT application No. WO 95/28098, it is suggested that cigarette additives can be formed from a complex of eukaryotic cell cultures with Vitamin E or a solution of natural substances of plant origin having anti-mutagenic and aromatizing properties also with Vitamin E. Nonetheless, there is no suggestion in this PCT publication that Vitamin E can have any efficacy as a stand-alone additive for cigarettes.

In U.S. Pat. No. 3,339,558 ("'558 patent") and U.S. Pat. No. 3,667,478 ("'478 patent"), Vitamin A is recommended as a primary cigarette additive to promote better health. The '558 patent teaches that the Vitamin A should be inserted within the cigarette filtering medium in rupturable capsules, while the '478 patent teaches that a stabilized aqueous emulsion of active Vitamin A should be applied to the tobacco in a cigarette. The '478 patent indicates that other vitamins, such as Vitamins C, D, E etc., can be added to the Vitamin A emulsion but does not suggest that any of the other vitamins can be advantageously used as a stand-alone additive.

As noted, none of this prior art suggests the use of Vitamin E or a Vitamin E analog as a stand-alone cigarette additive, much less what forms, quantities and delivery mechanisms should be used for such a stand-alone Vitamin E type additive.

SUMMARY OF THE INVENTION

The present invention provides an effective technique for adding a substantially pure Vitamin E type compound to cigarettes, cigars, bulk pipe tobacco and smokeless or "chewing" tobacco, as smokeless tobacco is commonly known. In smokeable tobacco products, such substantially pure Vitamin E additives have been unexpectedly found to achieve, to a great degree, a much less irritating smoke along with Vitamin E's antioxidant benefits. This beneficial effect may also apply to the second hand smoke irritation commonly experienced by non-smokers. In smokeless tobacco, substantially pure Vitamin E additives have been unexpectedly found to reduce irritation to the cheeks, gums, palette, throat and esophagus.

In a preferred embodiment, a substantially pure, "dry" powdered analog of Vitamin E, known as d-alpha tocopheryl acid succinate or Vitamin E acid succinate, is mixed directly with the tobacco used in smokeable or smokeless tobacco during the manufacturing process. This Vitamin E analog can also be inserted into a cigarette filter, holder or paper or wrapper. Other preferred "dry" forms of Vitamin E analog which can advantageously be used with the present invention are forms of d-alpha tocopheryl acetate, d-alpha tocopherol, dl-alpha-tocopherol or natural mixed tocopherols which are spray dried on a suitable carrier (e.g., gelatin or gum acacia). Although not preferred, a common clear, viscous oily form of natural Vitamin E (d-alpha tocopherol) or its liquid analogs can be used in the present invention so long as it is used in a way that does not ruin the appearance and function of the smokeable product (e.g., incorporated through microencapsulation or diffused into the tobacco or filter in such a way that it is stabilized and does not leach into cigarette paper or wrappers to show oily residue) or agglomerate smokeless tobacco.

DESCRIPTION OF THE SPECIFIC EMBODIMENTS

Figure 1:
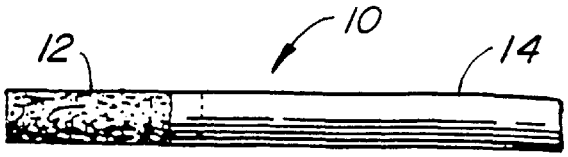
FIG. 1 shows a side elevation view of a typical cigarette.

Vitamin E or d-alpha tocopherol and its analogs have been found to act as an anti-inflammatory and an antioxidant which can deactivate cell-damaging free radicals. Vitamin E is most commonly obtained in a viscous, oily form from vegetable oil distillates. Vitamin E is then used in this oily form by either applying it directly to skin tissue or taking it orally in a capsulated daily vitamin supplement.

While the common oily form of Vitamin E may be acceptable for many uses, it presents problems when applied to the modified smokeable or smokeless tobacco of the present invention. For example, if common oily Vitamin E is applied directly to a cigarette, it will have a tendency to migrate and ooze into the cigarette paper and thereby ruin the feel and appearance of the cigarette. Also, the common oily form of Vitamin E will have a tendency to interact with tobacco and other natural ingredients in a way that may detrimentally affect the stability of the Vitamin E. It is for these reasons that "dry" analogs of Vitamin E are preferred for the present invention in order to best maintain a clean feel and appearance for the smokeable and smokeless tobacco as well as preserving the stability of the Vitamin E.

One "dry" ester analog of Vitamin E that is preferred for the present invention is known variously as d-alpha tocopheryl acid succinate, Vitamin E acid succinate, 2R, 4'R, 8'R-alpha-tocopheryl acid succinate, d-alpha-tocopheryl hydrogen succinate and 2,5,7,8-Tetramethyl-2-(4', 8', 12'-trimethyltridecyl)-6-chromanol acid succinate. Vitamin E acid succinate has an empirical formula of $C_{33}H_{54}O_5$ and a molecular weight of 530.79. The chemical structure of Vitamin E acid succinate is as follows:

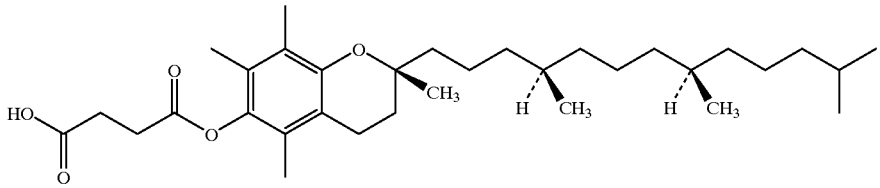

Vitamin E acid succinate is a succinate derivative of d-alpha tocopheryl in the form of a white to off-white crystalline powder with little or no odor or taste. Vitamin E acid succinate can be prepared by the vacuum distillation and succinylation of edible vegetable oil products. Vitamin E acid succinate can be commercially obtained from the Eastman Chemical Corporation of Kingsport, Tennessee as Eastman product PM4009 or E-1210. Vitamin E acid succinate can also be commercially obtained from the Henkel Corporation of LaGrange, Ill. as COVITOL® 1210 or from the Archer Daniels Midland Company of Decatur, Ill.

Another "dry" ester analog of Vitamin E that is preferred for the present invention is a spray dried, carrier based form of Vitamin E known variously as d-alpha tocopheryl acetate, Vitamin E acetate, 2R, 4'R, 8'R-alpha-tocopheryl acetate, and 2,5,7,8-Tetramethyl-2-(4', 8', 12'-trimethyltridecyl)-6-chromanol acetate. This alternative "dry" form of Vitamin E is also typically derived from vegetable oils and then spray dried onto a suitable carrier such as gelatin or gum acacia. Vitamin E acetate has an empirical formula of $C_{31}H_{52}O_3$ and a molecular weight of 472.75. The chemical structure of Vitamin E acetate is as follows:

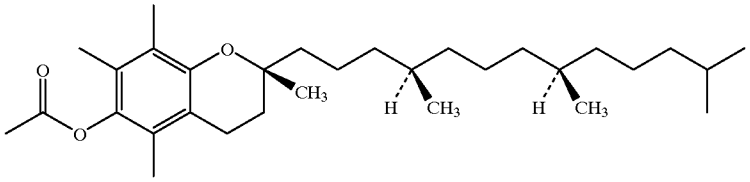

The preferred "dry" form of Vitamin E acetate is an acetate derivative of d-alpha tocopheryl in the form of a water-dispersible, fine powder containing d-alpha tocopheryl acetate spray-dried in a surface treated carrier. It is light tan in color with a bland odor and taste. Vitamin E acetate spray dried onto a gelatin carrier can be commercially obtained from the Archer Daniels Midland Corporation as product E-700. It can also be commercially obtained from the Henkel Corporation of LaGrange, Ill. as COVITOL® 700WD, a form of Vitamin E acetate which is spray dried onto a carrier of gum acacia.

Other "dry" forms of Vitamin E which are suitable for the present invention and can be obtained from Henkel Corporation include COVITOL® F-350M and COV-OX® T-30P. COVITOL® F-350M is a cream colored powder containing mixed natural tocopherols (i.e., including the α-, β-, γ- and δ-forms of tocopherol), spray dried on a carrier of gelatin, dextrin, and glucose that is surface treated. Taste and odor of COVITOL® F-350M is bland to mild. COV-OX® T-30P is a light color powder which also contains "natural mixed tocopherols" (i.e., including the α-, β-, γ- and δ- forms of tocopherol), spray dried on a carrier of gum acacia. Like COVITOL® F-350M, the taste and odor of COV-OX® T-30P is bland to mild. As another "dry" alternative, a synthetic form of Vitamin E, namely dl-alpha-tocopherol, which is spray dried onto a suitable carrier (e.g., gelatin or gum acacia) can be advantageously used for the present invention.

Figure 2:
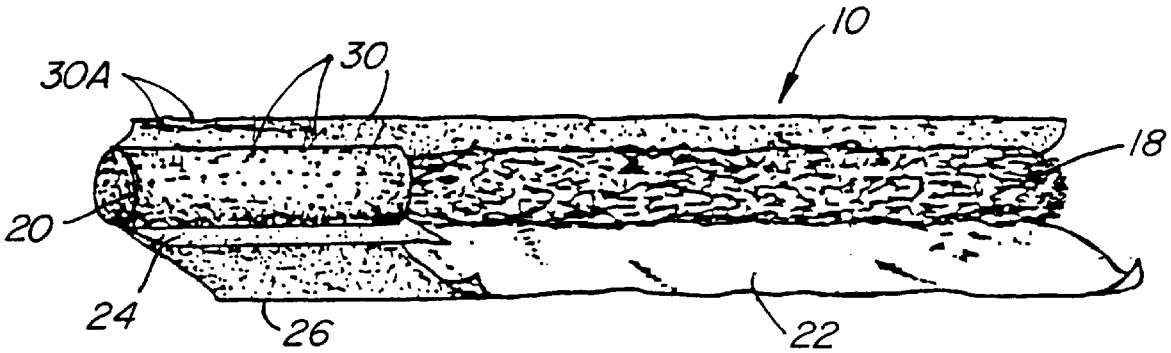
FIG. 2 shows a cutaway side elevation view of the typical cigarette of FIG. 1.

The preferred "dry" forms of Vitamin E can be incorporated into a smokeable or smokeless tobacco in a number of different ways including being directly mixed with the tobacco or inserted into the cigarette filter, holder or paper, either in its powdered form, spray dried form or in microencapsulated form. These methods of incorporation can best be explained in connection with the drawings. Referring now to FIG. 1, a typical form of cigarette 10 is shown which includes a filter section 12 and a tobacco section 14. A cutaway view of this typical cigarette is shown in FIG. 2, where the tobacco rod 18, filter 20, tobacco paper 22, plug wrap 24 and filter paper 26 can be more clearly seen.

In one embodiment of the present invention, a substantially pure, "dry" form of Vitamin E can be blended into, sprayed or dusted onto the full or cut tobacco leaves during the manufacturing process. In that way, the substantially pure, "dry" form of Vitamin E will already be incorporated onto the tobacco when it is rolled into the cigarette shown in FIGS. 1 and 2 or packaged in a bulk smokeless container. While the quantity of Vitamin E to be used in this process can vary, it is expected that between 0.1 and 5000 milligrams of Vitamin E or Vitamin E analog would be a suitable amount for a smokeable product or smokeless tobacco wad containing 400–1200 milligrams of tobacco, with a more preferred amount of Vitamin E or Vitamin E analog to be between 0.1% to 20.0% by weight of tobacco or 0.4 milligrams to 240 milligrams for a smokeable product or smokeless tobacco wad containing 400–1200 milligram of tobacco.

In a second embodiment, the "dry" form of Vitamin E can be incorporated into the cigarette filter 20 either as dispersed powder particles 30, liquid infused into the filter medium or microencapsulated powder particles 30A. Such powdered particles 30 or microencapsulated powdered particles 30A could also be incorporated into tobacco paper 22, plug wrap 24 and/or filter paper 26.

Figure 3:
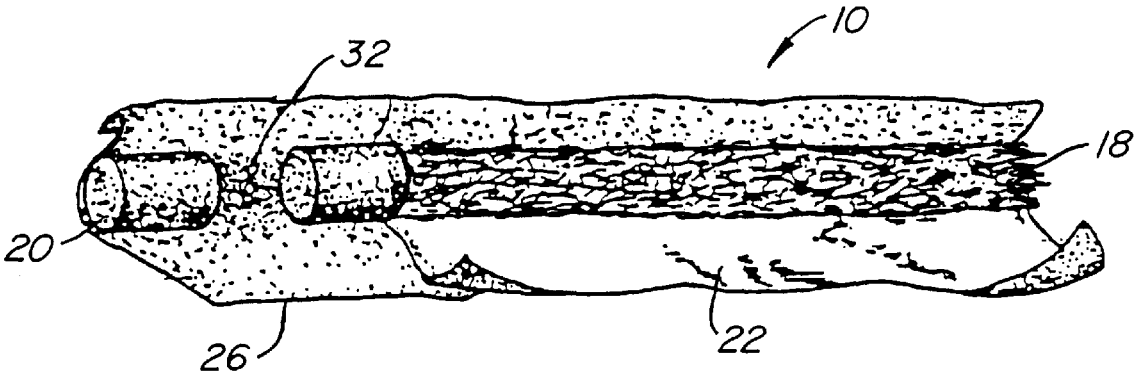
FIG. 3 shows a cut away side elevation view of an alternative form of cigarette which can accommodate a filter insert.
Figure 4:
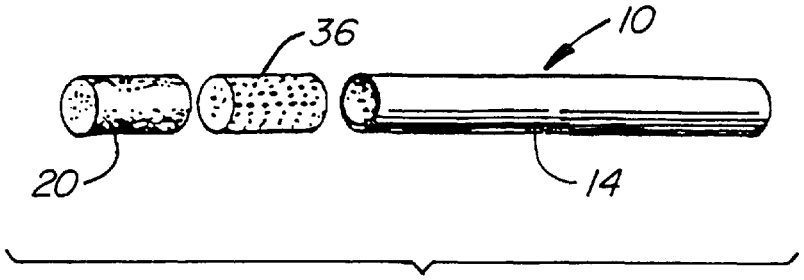
FIG. 4 shows a cutaway side elevation view of a second alternative form of cigarette which can accommodate a filter insert.

Referring now to FIG. 3, an opening 32 is shown in the middle of the filter 20 which can accommodate concentrated Vitamin E or Vitamin E analog in either powdered form or encapsulated form. Alternatively, as shown in FIG. 4, a Vitamin E or Vitamin E analog insert 36 could be made in the filter section between the actual filter 20 and the tobacco section 14. This insert 36 might contain an encapsulated section 14. This insert 36 might contain an encapsulated Vitamin E compound or suitably wrapped powdered Vitamin E compound (e.g., wrapped in paper). Similarly, a narrower Vitamin E insert (not shown) could be incorporated into the tobacco section 14 of the cigarette.

Microencapsulation can be used in the present invention as a suitable delivery device for a Vitamin E compound in its preferred "dry" form or more common oily form. Microencapsulation initially isolates the Vitamin E compound and provides for its controlled release so that, for a smokeable tobacco product, it can interact with its smoke stream environment. The shell wall microencapsulation construction should be sufficiently compatible with the Vitamin E compound contained therein to retain the Vitamin E compound until such time as the heat of the smoke causes the shell to open. In other words, the microcapsule is stable within the cigarette until it is smoked. At that point, the smoke's heat triggers the release of the Vitamin E compound.

Ideally, the shell wall should comprise between 20% and 50% of capsule volume for stability so as to resist rupture in the making, packing and consumer handling of the cigarette. The microcapsules should be 3 to 10 microns in circumference when placed on the cigarette paper 22, 24, 26 or mixed with the tobacco 18 so as to avoid undesired bumpiness on cigarette paper or to remain invisible if placed in the tobacco. Larger circumferences up to 50 microns are acceptable if the microcapsules are placed in the cigarette filter. Moreover, the capsules can be dyed with suitable food dyes to match the color of the filter or tobacco.

This Vitamin E microencapsulation can be accomplished by a shell wall construction referred to as the M-CAP Process of Insulation Technologies Corporation of Darby, Pa. The general specification of the M-CAP shell walls are capsules as small as three microns with melt temperatures of 64° F. to 650° F. The encapsulation material of the shell wall can be ELVAX™ (ethylene/vinyl acetate copolymers) or a similar cellulite material having the desired characteristics of a suitable shell wall release temperature between 64° F. and 650° F. ELVAX™ is an ethylene vinyl acetate resin, such as described in the "Material Safety Data Sheet—VAX001, " dated Oct. 20, 1986, of E.I. DuPont de Nemours & Co. of Wilmington, Del.

Other shell wall candidates include BERMOCOLL™ which is an ethylhydroryethylcellulose manufactured by Berol Kemi AB of Stenungsund, Sweden; K&K Gelatin, which is a gelatin manufactured by the Kind & Knox division of Knox Gelatine, Inc. of Saddle Brook, N.J.; N-LOK™, which is an emulsion stabilizing material of National Starch and Chemical Corporation of Bridgewater, N.J.; and CAPSUL™, a modified starch material, which is described in "Product Data: Bulletin No. 409" of National Starch and Chemical Corporation of Bridgewater, N.J. In the case of a smokeless tobacco product, the solubility to saliva of the powdered form of Vitamin E releases the active ingredients. In the case of the oily form of Vitamin E, or less soluble forms of Vitamin E, saliva will leach Vitamin E out along with other components of the smokeless tobacco product.

Aside from microencapsulation, use of the common oily form of Vitamin E is only recommended for the present invention where it introduced so as not to soak through the cigarette papers 22, 24, 26 or agglomerate smokeless tobacco. This might be best accomplished by applying the oily form of Vitamin E to the tobacco leaves shortly after harvesting. As the tobacco leaves are then taken through their various drying stages, the oily form of Vitamin E will have a tendency to soak into the tobacco leaves and thereby be less likely to migrate. This process might be aided through the addition of other suitable carriers or oil drying chemicals. As previously noted, though, the common oily, viscous form of Vitamin E will have a tendency to interact with tobacco and other natural ingredients in a way that may detrimentally affect the stability of the Vitamin E.

EXAMPLE 1

A comparison was made between a normal filterless cigarette and a filterless cigarette modified to include a substantially pure, "dry" form of Vitamin E analog. For this comparison, 7.5 grams of CHESTERFIELD® tobacco were removed from a CHESTERFIELD® cigarette and mixed with 0.1 grams of Vitamin E acid succinate. The mixed tobacco blend was formed into a filterless cigarette using a Rizla auto rolling box. A control cigarette, without Vitamin E analog additive, was also formed using the same Rizla auto rolling box.

When smoked, the control cigarette was found to cause throat and lung irritation for both a smoker and non-smoker. By contrast, the cigarette with Vitamin E acid succinate had the same flavor when smoked but was found to cause no throat or lung irritation for both the smoker and non-smoker.

EXAMPLE 2

A second comparison was made between a normal filtered cigarette, a filtered cigarette with oily Vitamin E injected into the filter and oily Vitamin E injected into the length of the tobacco. In this second comparison, the control cigarette was a normal MARLBORO® cigarette. In two separate MARLBORO® cigarettes, oily Vitamin E was taken from a Vitamin E capsule with a syringe and injected into the filter of one cigarette and into the length of the tobacco of the other cigarette.

The three cigarettes where then lit with a butane lighter and three equal, alternating puffs were taken from each cigarette by a non-smoker. The control cigarette was found to irritate the non-smoker's lungs and induce coughing. The cigarette with Vitamin E in the filter was found to be less irritating but still induced an unpleasant lung reaction and a slight cough. The cigarette with Vitamin E along the length of the tobacco yielded no irritation. Moreover, the flavor of the Vitamin E tobacco cigarette gave the impression of having been enhanced.

EXAMPLE 3

A third comparison was made between a normal wad of smokeless tobacco and a wad of smokeless tobacco modified to include a substantially pure, "dry" form of Vitamin E analog. For this comparison, 1.0 gram of unmodified SKOAL® long cut smokeless tobacco was first placed in the mouth of a non-tobacco chewer between the cheek and gum. This unmodified smokeless tobacco produced a pleasant flavor but also a simultaneous burning sensation in the mouth, throat and esophagus which, along with an induced cough, forced the non-tobacco chewer to spit out the unmodified smokeless tobacco. To clear the burning sensation from his mouth, the non-tobacco chewer washed his mouth out with water. Nonetheless, the burning sensation persisted in the mouth and throat for over 5 minutes after the initial washing.

Approximately four hours later, long enough to ensure the sensitivity and the burning sensation had completely subsided, the non-tobacco chewer then mixed 0.1 grams of Vitamin E acid succinate obtained from the Eastman Chemical Corporation of Kingsport, Tenn. with 10.0 grams of SKOAL® long cut smokeless tobacco. A 1.0 gram wad of this Vitamin E modified smokeless tobacco was then placed in the mouth of the non-tobacco chewer between the cheek and gum. Like the unmodified chewing tobacco, this Vitamin E modified chewing tobacco produced a similar pleasant flavor. Nonetheless, unlike the unmodified smokeless tobacco, the Vitamin E modified smokeless tobacco was completely non-irritating.

In the foregoing specification, the invention has been described with reference to specific preferred embodiments and methods. It will, however, be evident to those of skill in the art that various modifications and changes may be made without departing from the broader spirit and scope of the invention as set forth in the appended claims. For example, the Vitamin E compounds of the present invention can be used not only in cigarettes but also in other tobacco products such as cigars or pipe tobacco as well as tobaccoless smoking products (e.g., cannabis cigarettes). Like the cigarette applications which have been previously discussed, Vitamin E compounds could advantageously be mixed with cigar tobacco, pipe tobacco, smokeless tobacco or tobaccoless smoking and tobaccoless smokeless products during the manufacturing process. Alternatively, in the case of pipe tobacco, it could be mixed with the tobacco by the consumer before the tobacco mixture is loaded into a pipe. In the same manner, the consumer could add it to smokeless tobacco. For these reasons, the specification and drawings are, accordingly, to be regarded in an illustrative, rather than restrictive, sense; the invention being limited only by the appended claims.

What is claimed is:

1. A tobacco product comprising tobacco and an additive consisting essentially of a dry powdered form of d-alpha-tocopheryl acid succinate, d-alpha-tocopheryl acetate spray dried onto a suitable carrier, d-alpha-tocopherol spray dried onto a suitable carrier, mixed tocopherols spray dried onto a suitable carrier and/or dl-alpha-tocopherol spray dried onto a suitable carrier.

2. The tobacco product of claim 1 wherein said tobacco product is smokeless.

3. The tobacco product of claim 1 wherein said additive is between 0.1% and 20.0% by weight of the tobacco to which it is added.

4. The tobacco product of claim 1 wherein said additive is non-complexed.

5. The tobacco product of claim 1 wherein said product is smokable.

* * * * *